US006234536B1

(12) United States Patent
Pittman et al.

(10) Patent No.: US 6,234,536 B1
(45) Date of Patent: May 22, 2001

(54) LABEL STRUCTURE

(75) Inventors: James T. Pittman, Lula; Robert L. Everett, Sugar Hill; Benny R. Rich, Oakwood; James J. Carides, Lawrenceville, all of GA (US); Michael E. Bowser, Algoma, WI (US)

(73) Assignee: Dittler Brothers Incorporated, Atlanta, GA (US)

( * ) Notice: Subject to any disclaimer, the term of this patent is extended or adjusted under 35 U.S.C. 154(b) by 0 days.

(21) Appl. No.: 09/210,230

(22) Filed: Dec. 11, 1998

Related U.S. Application Data

(60) Provisional application No. 60/068,483, filed on Dec. 22, 1997.

(51) Int. Cl.[7] ..... A63F 3/06; B42D 15/00

(52) U.S. Cl. ..... 283/81; 283/101; 283/105; 283/901; 283/903; 40/310

(58) Field of Search ..... 283/81, 903, 901, 283/101, 105; 40/310

(56) References Cited

U.S. PATENT DOCUMENTS

| | | | | |
|---|---|---|---|---|
| 3,524,782 | * | 8/1970 | Buske | 156/248 |
| 4,479,838 | | 10/1984 | Dunsirn et al. . | |
| 4,846,504 | * | 7/1989 | MacGregor et al. | 283/102 |
| 5,024,014 | * | 6/1991 | Swierczek | 40/310 |
| 5,154,448 | * | 10/1992 | Griffin et al. | 283/102 |
| 5,228,692 | * | 7/1993 | Carrick et al. | 283/903 |
| 5,350,612 | * | 9/1994 | Stern et al. | 248/40 |
| 5,992,892 | * | 11/1999 | Schaefer et al. | 283/901 |

FOREIGN PATENT DOCUMENTS

654529 * 2/1986 (CH) .

* cited by examiner

*Primary Examiner*—A. L. Wellington
*Assistant Examiner*—Mark T. Henderson
(74) *Attorney, Agent, or Firm*—Dean W. Russell; Kilpatrick Stockton LLP

(57) ABSTRACT

The lottery ticket is composed of base sheet (1), cover sheet (2) and ticket sheet (3) lying therebetween. Base sheet (1) and cover sheet (2) are adhered to each other in the edge region (6). The adhesive means is strip-shaped. In addition, base sheet (1) and cover sheet (2) are perforated to each other. Said perforation (9–12) is line-shaped and lies in said edge region (6) provided with glue. The distance of the perforation (9–12) from the edge (4, 5) of base and cover sheet (1, 2) is in the region of 2–4 mm. The ticket sheet (3) is thus completely surrounded by a border (6) of glue and by a border (9–12) of perforations lying therein. The six surfaces of base sheet (1), ticket sheet (3) and cover sheet (2) are provided with a plurality of imprints in base areas covering one another. Due to these imprints which cover one another and hence cross one another, the ticket sheet (3) cannot be deciphered by means of examining against the light when the lottery ticket is unopened. Due to the perforation (9–12) the border (6) of glue of the ticket sheet (3) cannot be penetrated by mechanical interventions without the edge of the lottery ticket being visibly damaged. Due to a glue which cannot be dissolved by various non-mechanical actions, the barrier of the border (6) of glue cannot be overcome.

10 Claims, 2 Drawing Sheets

LABEL STRUCTURE

REFERENCE TO PROVISIONAL APPLICATION

This application is based on and hereby refers to U.S. Provisional patent application Ser. No. 60/068,483, filed Dec. 22, 1997, having the same title as appears above.

FIELD OF THE INVENTION

This invention relates to labels and structural features thereof and more particularly to labels having game pieces, coupons, or promotional materials therein and which retain their integrity notwithstanding immersion in liquid for extended periods.

BACKGROUND OF THE INVENTION

U.S. Pat. No. 4,846,504 to MacGregor, et al., incorporated herein in its entirety by this reference, discloses various "secure on-pack promotional coupons." Such coupons include concealed promotional materials and may be secured to packaging of consumer products. In one embodiment of the assemblies described in the MacGregor, et al. patent, the coupons consist of a set or series of labels, each label formed of a base portion, an intermediate (promotional) portion, and an outer portion.

Repeatedly emphasized in the MacGregor, et al. patent is the requirement that the promotional coupon be > secured to a product by water soluble adhesive, so that the purchaser of the product must run water over the label or coupon in order to expose the coupon . . . and remove it from the product.

See MacGregor, col. 1, lines 56–60; see also id., col. 2, lines 20–23; col. 4, line 67 through col. 5, line 6. According to the MacGregor, et al. patent, this requirement purportedly deters "persons from removing or tampering with the labels prior to purchasing the products." See id., col. 1, lines 63–65. It is, moreover, based on the assumption that water (or other liquid) is of only "limited availability . . . in stores." See id., line 61.

While not necessarily erroneous, the assumption made in the MacGregor, et al. patent is inconsistent with certain present-day practices. For example, grocery and convenience stores (among others) now often include freestanding displays in which plastic beverage bottles are wholly or partially immersed in ice water. Conventional coolers and other containers similarly surround bottles with ice water in many cases. In each of these instances, promotional coupons of the type disclosed in the MacGregor, et al. patent may lose their integrity through immersion in or contact with water. As the water contacts the promotional coupons, the effectiveness of the water-soluble adhesive is diminished, resulting in premature separation of the outer portion from the remainder of the assembly and undesired exposure of the intermediate (promotional) portion.

Moreover, some types of plastic and other bottles are cleansed with hot water after all labelling is affixed. This cleansing is also likely to disturb the water-soluble adhesive used in the promotional coupons of the MacGregor, et al. patent and precipitate loss of integrity of the overall label assembly. Again, the result is premature separation of the outer portion and exposure of the promotional material.

Among initial attempts to solve this problem associated with water baths was utilizing a film to attach a paper game piece to a bottle. The larger film, to which adhesive was applied to the perimeter of its underside, effectively sandwiched the game piece against the outer surface of the bottle.

Any defect in applying the film to the bottle permitted water to seep beneath the film into contact with the paper game piece, however, diminishing its viability as a solution to the problem.

SUMMARY OF THE INVENTION

By contrast, the present invention avoids problems associated with, among other things, these water baths by providing a multi-ply label structure in which a game piece is sealed from the ambient environment before affixation to a bottle. Because developed for purposes different than the promotional coupons of the MacGregor, et al. patent, moreover, the label structures of the present invention do not utilize water-soluble adhesive to attach components to a bottle. Instead, the innovative labels described herein are designed especially to retain their integrity notwithstanding immersion in either hot or cold water (or other liquid) for extended periods.

One embodiment of the invention includes four plies. In this embodiment the base ply may be a polypropylene or other liner whose underside is adherable to, among other things, a plastic bottle. Positioned atop the liner, and typically (although not necessarily) of lesser length and width, is a first polypropylene or similar film. The underside of the first film may in some cases be temporarily adhered to the upper surface of the liner, thereby forming a laminated structure.

Adhered to the base ply along the perimeter of its upper surface is a second polypropylene or other film. This second film constitutes the top of the multi-ply structure, and together with the base ply forms a pouch in whose central area a game piece, coupon, or other material may reside. The base ply and second films and the adhesive attaching them are selected so as to be water-impervious, thereby sealing the game piece from any water that might contact the label. Thus, neither immersion in water of a bottle containing such a label nor defective affixation of the label to the bottle is likely to destroy the integrity of the multi-ply assembly or the contents of the game piece contained therein.

As noted above, if desired the underside of the first film may contain adhesive to prevent the game piece from changing position within the pouch. The multi-ply assembly additionally may be manufactured on a backing tape or web for easy storage and transport in rolls. Such web, as is conventional, would have an upper surface coated with a release layer to facilitate removal of the assembly for affixing to a bottle. Because the game piece is protected from moisture while within the assembly, furthermore, it may include inks, scratch-off coverings, and other features that it otherwise could not successfully have. Moreover, because the first film may be part of the game piece, in some cases it may provide additional moisture resistance as well.

It is therefore an object of the present invention to provide a label structure that includes a game piece, coupon, or other promotional material.

It is another object of the present invention to provide a label structure which retains its integrity notwithstanding immersion in liquid for extended periods.

It is an additional object of the present invention to provide a label structure in which the game piece forming part of the assembly is sealed from the ambient environment before being affixed to, e.g., a bottle.

It is a further object of the present invention to provide a label structure avoiding use of a water-soluble adhesive to attach any portion of the structure to a bottle or other surface.

It is also an object of the present invention to provide a four-ply label including two layers of film and a base layer positioned intermediate the film layers and a substrate such as a bottle.

Other objects, features, and advantages of the present invention will become apparent with reference to the remainder of the text and the drawings of this application.

DETAILED DESCRIPTION

Figure 1:
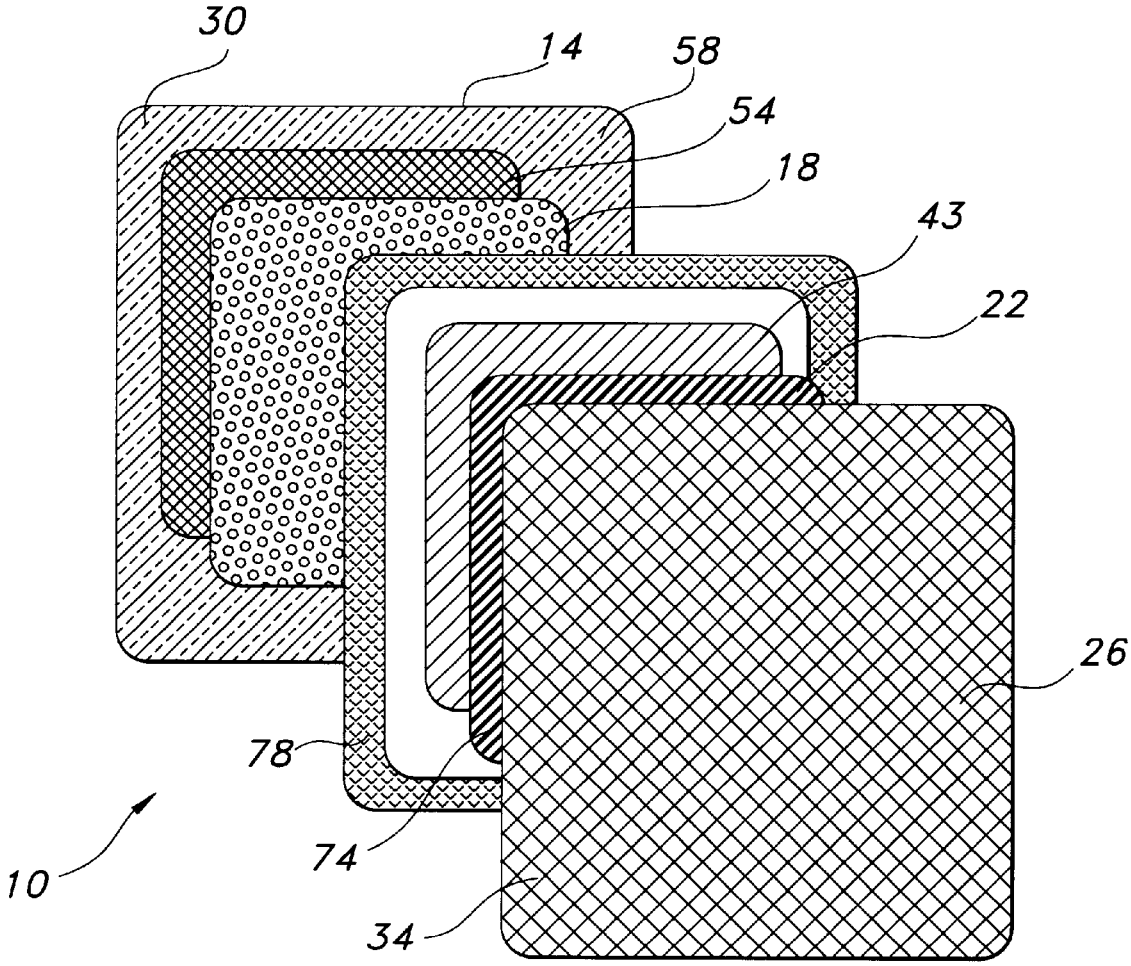
FIG. 1 is an exploded perspective view of a label structure of the present invention.
Figure 2:
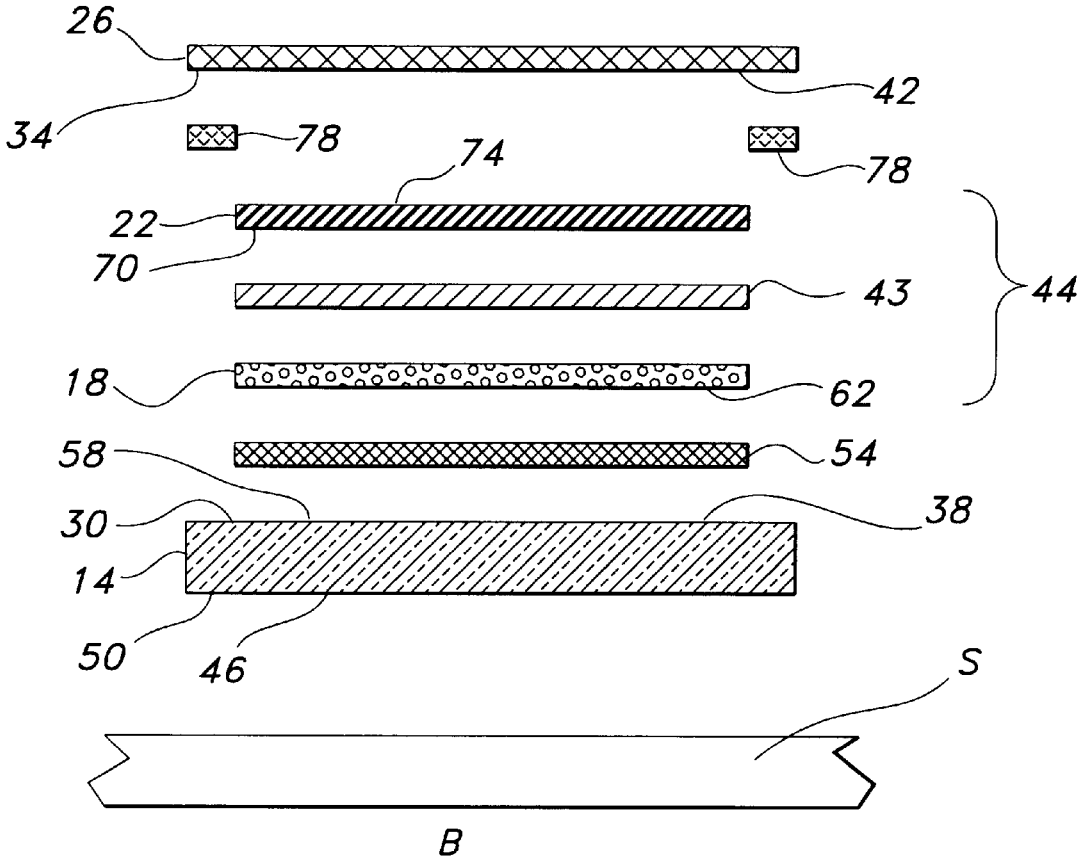
FIG. 2 is an exploded cross-sectional view of the label structure of FIG. 1 before attachment to a bottle.

Illustrated in FIGS. 1–2 is an exemplary label structure or assembly 10 of the present invention. The embodiment of assembly 10 shown in FIGS. 1–2 may include four plies: base 14, first layer 18, game portion 22, and second layer 26. In use, these plies are effectively laminated to form the single assembly 10 which may be attached to a substrate such as bottle B.

Each of base 14 and second layer 26 may have the same length and width if necessary or desired. Equating dimensions of these components may enhance the aesthetic appeal of assembly 10 in some cases and promote protection of game portion 22 from the ambient environment. Base 14 and second layer 26 need not be dimensioned identically, however, nor need they be substantially rectangular as shown in FIGS. 1–2. Instead, those skilled in the art will recognize that these components may have different dimensions and shapes than those expressly illustrated herein.

Generally, however, the length and width of game portion 22 and first layer 18 will be less than those of base 14 and second layer 26. This permits base 14 and second layer 26 to encapsulate game portion 22 when their respective peripheries 30 and 34 are adhered. As so encapsulated, game portion 22 is sealed in a pouch formed between central areas 38 and 42 of base 14 and second layer 26, respectively.

Certain embodiments of assembly 10 are designed to include clear polypropylene film (which may be one mil thick) as both first and second layers 18 and 26. Because such film is impervious to water, sealing game portion 22 underneath second layer 26 helps prevent any substantial seepage of moisture into the pouch containing portion 22. Thus, game portion 22 is not typically subjected to the detrimental effects of moisture even should it be bathed or immersed in water for an extended period of time. This avoidance permits game portion 22 to have numerous features (such as inks, scratch-off materials, etc.) to enhance its promotional or entertainment abilities that otherwise could not be present if subject to contact with moisture. When present, first layer 18 may be adhered to game portion 22 using water-based or other adhesive 43 to form game piece 44. In such cases, the water-impervious nature of first layer 18 may further assist in protecting portion 22 from moisture.

Base 14 may, if desired, be a layer of greater thickness than layers 18 and 26. In addition to helping seal game portion 22 from moisture, base 14 functions to attach the remainder of assembly 10 to bottle B or another substrate. It thus must be sufficiently thin and flexible to accommodate and conform to the contoured surface S of bottle B yet sufficiently strong to maintain its structural integrity when subjected to automatic affixation techniques, temperature extremes, and moisture. A presently-preferred material for base 14 is a 2.9 mil thick white polypropylene film with a #40 liner, which also has sufficient opacity to prevent someone from visually discerning the contents of game portion 22 by peering through whatever liquid is contained within bottle B. Because a consumer need not remove base 14 from the bottle B to access game portion 22, base 14 may be attached to the bottle B using a substantially permanent pressure-sensitive or other adhesive 46 placed on its underside 50.

By contrast, first layer 18 is typically removed from bottle B as part of game piece 44. Any suitable adhesive 54, including one cured using ultraviolet radiation (a "UV adhesive"), may thus be applied either to upper surface 58 of base 14 or underside 62 of layer 18 (or both) to adhere the two together. Depending on the material chosen for base 14 and game portion 22, in some situations first layer 18 may be omitted.

Placed atop adhesive 54 and upper surface 58 (in central area 38) is game piece 44. If completely or substantially opaque, game portion 22 of piece 44 may include text, symbols, or other information on its underside 70 that is obscured from view on the one hand by its upper surface 74 and on the other by base 14. Similarly, because game portion 22 obscures central area 38 of upper surface 58 from view, hidden textual or other information may be printed or otherwise included thereon as well. As noted above, scratch-off or other material, including any or all of the elements of the cards disclosed in U.S. Pat. Nos. 5,569,512 to Brawner, et al. and U.S. Pat. No. 5,601,887 to Rich, et al. (incorporated herein in their entireties by this reference), may be included on either or both of underside 70 or upper surface 74 of game portion 22.

To encapsule game piece 44, adhesive 78 is applied to either or both of peripheries 30 and 34 to bond them together. Doing so effectively forms a pouch between central areas 38 and 42 in which game piece 44 resides. If necessary or appropriate to prevent piece 44 from moving within the pouch, adhesive 54 may be used to attach underside 62 to upper surface 58. Adhesives 78 and 54 may, in the vernacular of the MacGregor, et al. patent, be "removable" or otherwise temporary bonding agents, as they usually should not prevent a consumer from removing game piece 44 from the remainder of assembly 10.

To access piece 44, in most cases the consumer need merely peel second film 26 away from the remainder of the assembly 10. Facilitating such removal may be information printed on upper surface 58 of base 14 such as the phrase "pull here" and an arrow pointing to a corner of assembly 10. Removing second film 26 exposes upper surface 74 of game portion 22. If (temporary) adhesive 54 is present, a consumer may merely peel composite game piece 44 away from upper surface 58 of base 14 to expose underside 62 and remove the piece 44 from the remainder of assembly 10. Those skilled in the art will recognize that game piece 44 is not limited to two-sided structures, but may instead contain folds, cut-outs, or pop-ups, for example, or otherwise be more complex than a simple two-sided material. Alternatively, in some cases piece 44 need not include first layer 18 and adhesive 43.

The foregoing is provided for purposes of illustrating, explaining, and describing embodiments of the present invention. Further modifications and adaptation to these embodiments will be apparent to those skilled in the art and may be made without departing from the scope of spirit of the invention.

We claim:

1. A label assembly comprising:

a. a water-impervious base having an upper surface and an underside, the upper surface defining a central area bounded at least in part by a periphery;

b. a water-impervious second layer defining a central area bounded at least in part by a periphery;

c. a game piece interposed between the respective central areas of the second layer and the upper surface of the base, the game piece containing ink or a scratch-off covering susceptible to degradation should it be contacted by moisture; and d. water-impervious adhesive applied to at least one of the respective peripheries of the second layer and the upper surface of the base so as to adhere the base and second layer.

2. A label assembly according to claim 1 in which the adhesive permits manual separation of the base and second layer to expose the game piece, further comprising a substantially permanent adhesive affixed to the underside of the base.

3. A label assembly according to claim 1 in which the game piece contains printed information obscured from view when the base and second layer are adhered.

4. A label assembly according to claim 1 in which the upper surface of the base contains text or at least one symbol.

5. A label assembly according to claim 1 in which each of the game piece, the central area of the second layer, and the central area of the base has a respective length and width, the length of the game piece being not greater than the lengths of the central areas of the second layer and base and the width of the game piece being not greater than the widths of the central areas of the second layer and base.

6. A bottle to which the label of claim 1 is adhered.

7. A label assembly comprising:

a. a water-impervious base having an upper surface and an underside, the upper surface defining a central area bounded at least in part by a periphery;

b. a water-impervious second layer defining a central area bounded at least in part by a periphery;

c. a game piece interposed between the respective central areas of the second layer and the upper surface of the base and comprising a game portion having an underside and a first layer adhered to the underside; and d. water-impervious adhesive applied to at least one of the respective peripheries of the second layer and the upper surface of the base so as to adhere the base and second layer.

8. A label assembly according to claim 7 in which the first layer is impervious to water and the game portion is not impervious to water.

9. A label assembly according to claim 8 in which the base and first and second layers are made of polypropylene.

10. A label assembly comprising:

a. a plastic film base impervious to water and having:

i. an upper surface defining a central area having length and width and bounded by a periphery; and ii. an underside to which substantially permanent, non-water soluble adhesive is applied to allow attachment to a substrate;

b. a plastic film second layer impervious to water and having:

i. an upper surface defining a face of the label assembly; and ii. an underside defining a central area having length and width and bounded by a periphery;

c. a game piece interposed between the respective central areas of the underside of the second layer and the upper surface of the base, having a length not greater than the lengths of the respective central areas and a width not greater than the widths of the respective central areas, and comprising:

i. a non-plastic game portion having an upper surface abutting the central area of the underside of the second layer and a lower surface on which information is printed, the information being obscured from view when the label assembly is intact and susceptible to degradation in legibility should it be contacted by moisture;

ii. a plastic film first layer; and iii. a water-based adhesive adhering the first layer and game portion;

d. a UV adhesive releasably adhering the first layer to the central area of the upper surface of the base; and a water-impervious adhesive releasably adhering the respective peripheries of the upper surface of the base and the underside of the second layer.

* * * * *

UNITED STATES PATENT AND TRADEMARK OFFICE

CERTIFICATE OF CORRECTION

PATENT NO. : 6,234,536 B1
DATED : May 22, 2001
INVENTOR(S) : James T. Pittman et al.

It is certified that error appears in the above-identified patent and that said Letters Patent is hereby corrected as shown below:

Column 6,
Line 10, insert -- a -- after "which".
Line 39, insert -- e. -- before "a".

Signed and Sealed this

Ninth Day of April, 2002

*Attest:*

*Attesting Officer*

JAMES E. ROGAN
*Director of the United States Patent and Trademark Office*